US012662815B2

(12) United States Patent
Underkofler et al.

(10) Patent No.: US 12,662,815 B2
(45) Date of Patent: Jun. 23, 2026

(54) LINEAR METAL CEILINGS

(71) Applicant: USG Interiors, LLC, Chicago, IL (US)

(72) Inventors: Abraham M. Underkofler, Salem, WI (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 208 days.

(21) Appl. No.: 18/466,942

(22) Filed: Sep. 14, 2023

(65) Prior Publication Data

US 2025/0092676 A1 Mar. 20, 2025

(51) Int. Cl.

| | |
|---|---|
| ***E04B 9/22*** | (2006.01) |
| ***E04B 9/04*** | (2006.01) |
| ***E04B 9/06*** | (2006.01) |

(52) U.S. Cl.

CPC ..... *E04B 9/225* (2013.01); *E04B 9/0435* (2013.01); *E04B 9/068* (2013.01)

(58) Field of Classification Search

CPC ..... E04B 9/22; E04B 9/0435; E04B 9/0478; E04B 9/241; E04B 9/28; E04B 9/363; E04B 9/068

See application file for complete search history.

(56) References Cited

U.S. PATENT DOCUMENTS

| | | | | |
|---|---|---|---|---|
| 4,270,327 | A | 6/1981 | Van Leeuwen | |
| 4,309,858 | A | 1/1982 | Anderle | |
| 4,328,653 | A | 5/1982 | Anderle | |
| 4,441,297 | A | 4/1984 | Rijnders | |
| 4,646,506 | A * | 3/1987 | Slapsys | E04B 9/363 52/460 |
| 4,671,041 | A | 6/1987 | Rijnders | |
| 6,336,302 | B1 * | 1/2002 | Brugman | E04B 9/26 52/489.1 |
| 6,931,907 | B2 * | 8/2005 | Yuan | E04C 2/08 72/379.2 |
| 7,143,562 | B2 | 12/2006 | Krantz-Lilienthal et al. | |
| 8,857,121 | B2 | 10/2014 | Baxter et al. | |
| 9,834,928 | B2 | 12/2017 | Baxter et al. | |
| 10,094,105 | B2 | 10/2018 | Harnish et al. | |
| 10,100,519 | B2 | 10/2018 | Bergman et al. | |
| 10,472,817 | B2 | 11/2019 | Harnish et al. | |
| 10,683,664 | B2 * | 6/2020 | Langeveld | E04B 9/366 |
| 11,447,945 | B2 | 9/2022 | Harnish et al. | |

(Continued)

FOREIGN PATENT DOCUMENTS

| | | | |
|---|---|---|---|
| AT | 245210 B | * | 2/1966 |
| CN | 201024562 Y | * | 2/2008 |

(Continued)

OTHER PUBLICATIONS

International Search Report and Written Opinion mailed Jan. 9, 2025 in International Application No. PCT/US2024/045577.

*Primary Examiner* — Adriana Figueroa
(74) *Attorney, Agent, or Firm* — Wentsler LLC; Brian M. Wishnow

(57) ABSTRACT

The invention provides a carrier adapted to be fixed to the face of a grid tee, such as by screws, with spaced depending flanges that are formed with panel supporting hooks. The hooks are configured to support a variety of panel cross-sections and provide a strong coupling with complementarily shaped panel flanges.

1 Claim, 2 Drawing Sheets

(56) References Cited

U.S. PATENT DOCUMENTS

| | | | | |
|---|---|---|---|---|
| 11,486,141 | B2 * | 11/2022 | Baxter | E04B 9/065 |
| 11,608,636 | B1 * | 3/2023 | Underkofler | E04B 9/225 |
| 2018/0334803 | A1 * | 11/2018 | Underkofler | E04B 9/127 |
| 2021/0301525 | A1 | 9/2021 | Baxter et al. | |
| 2022/0018127 | A1 * | 1/2022 | Magin | E04B 9/065 |
| 2023/0025771 | A1 | 1/2023 | Baxter et al. | |

FOREIGN PATENT DOCUMENTS

| | | | |
|---|---|---|---|
| EP | 0633365 | A2 | 1/1995 |
| FR | 2425516 | A1 * | 12/1979 |

* cited by examiner

LINEAR METAL CEILINGS

BACKGROUND OF THE INVENTION

The invention relates to linear panels and carriers for the panels.

PRIOR ART

Numerous proposals for carrier and panel combinations have been proposed. Often the carrier is provided as an inverted U-shaped channel with the channel sides providing hooks for retaining the panels. Prior art carriers and panels often had limited coupling or retention force. Still further, prior art carriers had limited capacity in receiving a variety of different panel designs. No-reveal panels, those installed with no space between their visible edges, typically were not easily removed from operations at their visible sides to gain access to a space behind the panels.

SUMMARY OF THE INVENTION

The invention provides a carrier adapted to be fixed to the face of a grid tee, such as by screws, with spaced depending flanges that are formed with panel supporting hooks. The hooks are configured to support a variety of panel cross-sections and provide a strong coupling with complementarily shaped panel flanges.

DESCRIPTION OF THE PREFERRED EMBODIMENTS

Figure 1:
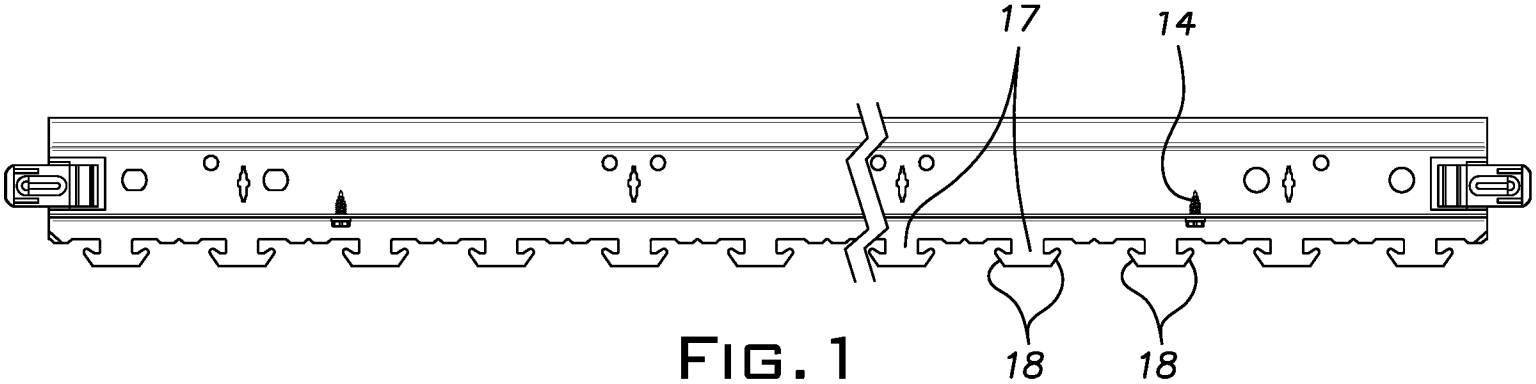
FIG. 1 is a side view of a carrier of the invention fixed to the underside face of a grid tee.
Figure 2:
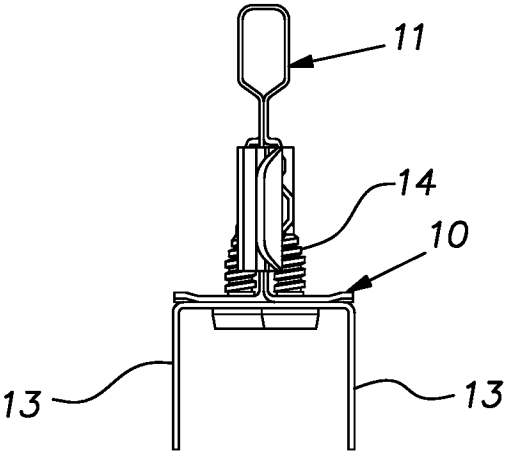
FIG. 2 on an enlarged scale is an end view of the carrier and grid tee.

Referring to FIGS. 1 and 2, there is shown a sheet metal panel carrier 10 attached to the underside face of a grid tee 11 which ordinarily is a heavy duty main tee. The carrier is a U-shaped channel, inverted in ceiling use, and having depending flanges or legs 13. The carrier 10 is attached to a grid tee 11 with self-drilling screw fasteners 14 on alternate sides of the grid tee web. In ordinary use, the carrier 10 will be used in a ceiling application and therefore will be horizontally disposed; accordingly, the description here has reference to this orientation.

Projections 17 from the flanges 13 are all identical and those of one flange are transversely aligned with those of the other flange. The projections 17 are regularly longitudinally spaced on nominal 2 inch centers. At their free ends, the projections 17 have oppositely extending hooks 18 with downwardly inclined upper surfaces 19 that are farther from the flange 13 the closer to the projection. The distance across the tips of the hooks 18 of a projection 17 being less than the distance between adjacent hook tips of adjacent projections.

Figure 3:
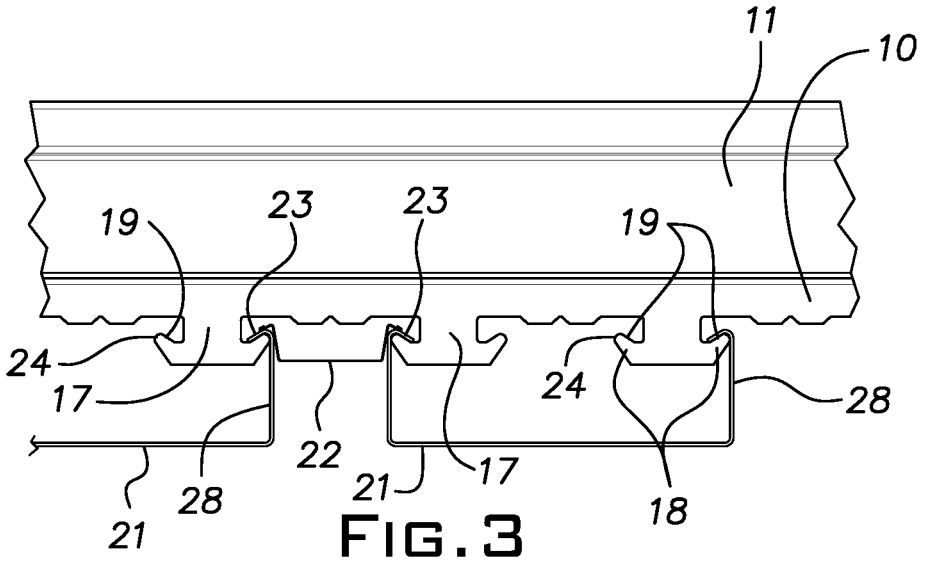
FIG. 3 is an end view of two reveal style panels spaced by a non-integral insert.

The carrier 10 is completely non-directional and is compatible with a wide variety of panel cross-sections of differing depth and width and a typical length of, for example, 12 feet. Referring to FIG. 3, there are shown reveal panels 21 on opposite sides of a reveal panel insert 22. The insert 22 can be installed from below after the panels 21 are in place and can be removed from below, with a flat tool such as a putty or taping knife used to flex the insert 22 into position. Alternatively, the inserts 22 can be installed from above the ceiling by threading them under the carriers 10 and sliding them along the panel edges 23, 28. Note that in this and other instances a panel has lips 23 at the free ends of its flanges 28 that are formed to closely follow and contact the hook contour at upper surface 19 and free end 24 of a hook 18. Where this close contact exists the associated panel is retained on the carrier 10 with a high retention force that is important in seismic applications or outdoor applications. With the insert 22 in place, its lips maintain the panel lips 23 in place on the hooks 18 further increasing the retention force.

Figure 4:
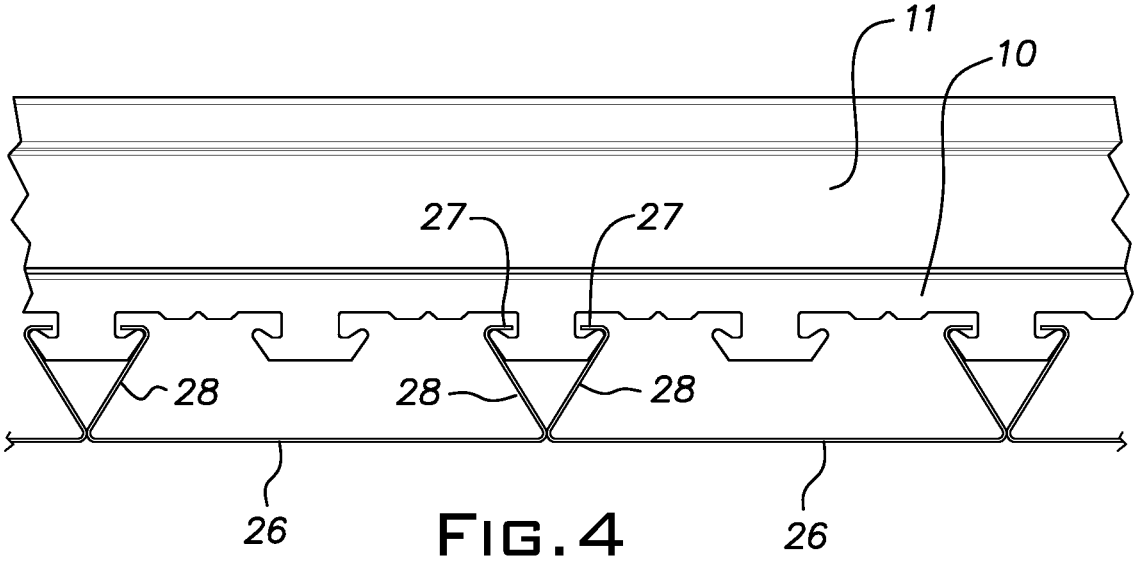
FIG. 4 is an end view of no-reveal panels.

FIG. 4 illustrates no-reveal panels 26 that contact edges of adjacent panels. In this case lips 27 are horizontal and do not follow the contour of carrier hooks 18. The no-reveal panels 26 are accessible or removeable from below. A flat tool such as a putty knife or a taping knife is inserted between contacting edges of the panels 26 and is used to pry the lip 27 off the associated hook 18. This is possible since the geometry of a flange 28 of the panel 26 and the projection 17 enables a tip of the removal tool to unobstructively engage the area between the hook 18 and flange 28, an imaginary line between the line of contact between the panels 26 and such area being unobstructed.

Figure 5:
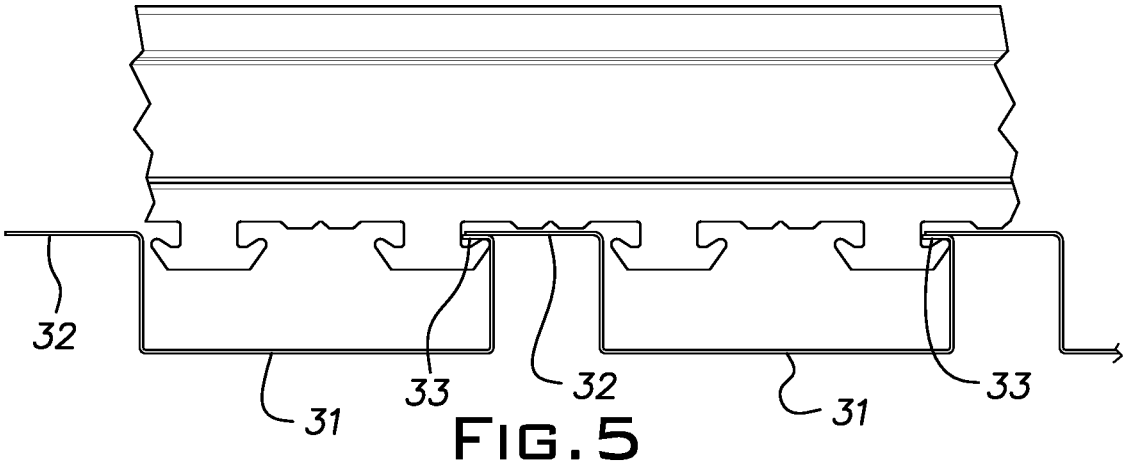
FIG. 5 is an end view of integral reveal panels.

FIG. 5 illustrates integral reveal panels 31. The panels 31 are non-symmetrical by virtue of one side of the panel having a horizontally extended lip 32. An opposite lip 33, while shorter, can also be horizontal.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In combination, a carrier and a pair of non-reveal panels carried by the carrier, longitudinal edges of the panels abutting each other below a pair of oppositely extending hooks of a depending projection of the carrier, the panels having upstanding flanges with outturned lips, the lips of each panel engaged with an associated hook of the pair of oppositely extending hooks, an imaginary unobstructed straight line existing between a lowermost line of contact between the panels and a distal part of a flange of the upstanding flanges adjacent a juncture with its associated lip, whereby the flange can be removed with a flat tool inserted between the line of contact between panels.

* * * * *